US007584797B2

(12) United States Patent
Dallas

(10) Patent No.: US 7,584,797 B2
(45) Date of Patent: Sep. 8, 2009

(54) METHOD OF SUBSURFACE LUBRICATION TO FACILITATE WELL COMPLETION, RE-COMPLETION AND WORKOVER

(75) Inventor: L. Murray Dallas, Fairfield, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 326 days.

(21) Appl. No.: 11/397,838

(22) Filed: Apr. 4, 2006

(65) Prior Publication Data

US 2007/0227743 A1 Oct. 4, 2007

(51) Int. Cl.
*E21B 33/068* (2006.01)

(52) U.S. Cl. ..... 166/381; 166/386; 166/378; 166/75.13

(58) Field of Classification Search ..... 166/381, 166/386, 378, 321, 75.13
See application file for complete search history.

(56) References Cited

U.S. PATENT DOCUMENTS

| | | | | |
|---|---|---|---|---|
| 2,555,145 | A | 5/1951 | McKinney | |
| 2,755,863 | A | 7/1956 | Stansbury, Jr. et al. | |
| 3,071,190 | A | 1/1963 | Ehlert | |
| 3,212,581 | A | 10/1965 | Marshall | |
| 3,216,500 | A | 11/1965 | Diehl | |
| 3,415,317 | A | 12/1968 | Drivet | |
| 3,435,895 | A | 4/1969 | Lee | |
| 3,568,767 | A | 3/1971 | Weiss | |
| 3,732,928 | A | 5/1973 | Sizer | |
| 3,924,686 | A | 12/1975 | Arnold | |
| 4,522,370 | A * | 6/1985 | Noack et al. | 251/63.5 |
| 4,681,168 | A | 7/1987 | Kisling, III | |
| 4,993,492 | A | 2/1991 | Cressey et al. | |
| 5,123,356 | A | 6/1992 | Brooks et al. | |
| 5,509,481 | A | 4/1996 | Huber et al. | |
| 5,529,127 | A | 6/1996 | Burleson et al. | |
| 5,568,837 | A | 10/1996 | Funk | |
| 5,785,121 | A | 7/1998 | Dallas | |
| 5,819,851 | A | 10/1998 | Dallas | |
| 5,848,646 | A | 12/1998 | Huber et al. | |
| 5,857,523 | A | 1/1999 | Edwards | |
| 5,927,403 | A | 7/1999 | Dallas | |
| 5,988,274 | A | 11/1999 | Funk | |
| 6,015,014 | A | 1/2000 | Macleod et al. | |
| 6,056,055 | A | 5/2000 | Falconer et al. | |
| 6,089,832 | A * | 7/2000 | Patterson | 417/360 |
| 6,289,993 | B1 | 9/2001 | Dallas | |
| 6,328,111 | B1 | 12/2001 | Bearden et al. | |
| 6,364,024 | B1 | 4/2002 | Dallas | |

(Continued)

OTHER PUBLICATIONS

U.S. Appl. No. 11/397,077, entitled "A Casing Transition Nipple and Method of Casing a Well to Facilitate Well Completion, Re-Completion and Workover," filed Apr. 4, 2006.

*Primary Examiner*—Shane Bomar
(74) *Attorney, Agent, or Firm*—Nelson Mullins Riley & Scarborough, LLP

(57) ABSTRACT

A method of subsurface lubrication facilitates well completion, re-completion and workover while increasing safety and reducing expense. The method involves using a subsurface lubricator mounted to a wellhead of the cased wellbore to lubricate a downhole tool string into the cased wellbore by running a subsurface lubricator through the wellhead and into an upper section of a production casing of the cased wellbore.

18 Claims, 10 Drawing Sheets

U.S. PATENT DOCUMENTS

| | | | | |
|---|---|---|---|---|
| 6,401,826 | B2 * | 6/2002 | Patel | 166/375 |
| 6,412,560 | B1 | 7/2002 | Bernat | |
| 6,491,098 | B1 | 12/2002 | Dallas | |
| 6,571,868 | B2 | 6/2003 | Victor | |
| 6,595,297 | B2 | 7/2003 | Dallas | |
| 6,601,648 | B2 * | 8/2003 | Ebinger | 166/297 |
| 6,609,571 | B2 | 8/2003 | Nice et al. | |
| 6,712,147 | B2 | 3/2004 | Dallas | |
| 6,755,244 | B1 | 6/2004 | Koopmans | |
| 6,827,147 | B2 | 12/2004 | Dallas | |
| 7,004,020 | B2 * | 2/2006 | Schrenkel et al. | 73/152.18 |
| 7,066,269 | B2 | 6/2006 | Dallas et al. | |
| 7,159,663 | B2 | 1/2007 | McGuire et al. | |
| 7,210,525 | B2 | 5/2007 | Dallas | |
| 2001/0023765 | A1 * | 9/2001 | Patel | 166/375 |
| 2002/0029890 | A1 * | 3/2002 | Patel | 166/386 |
| 2002/0117308 | A1 * | 8/2002 | Dallas | 166/382 |
| 2003/0112150 | A1 * | 6/2003 | Schrenkel et al. | 340/853.1 |
| 2007/0095546 | A1 * | 5/2007 | Farquhar et al. | 166/386 |

* cited by examiner

METHOD OF SUBSURFACE LUBRICATION TO FACILITATE WELL COMPLETION, RE-COMPLETION AND WORKOVER

FIELD OF THE INVENTION

This invention generally relates to hydrocarbon well completion, recompletion and workover and, in particular, to a method of subsurface lubrication to facilitate well completion, re-completion and workover.

BACKGROUND OF THE INVENTION

Most oil and gas wells require some form of stimulation to enhance hydrocarbon flow to make or keep them economically viable. The servicing of oil and gas wells to stimulate production requires the pumping of fluids under high pressure. The fluids may be caustic and are frequently abrasive because they are laden with abrasive propants such as sharp sand, bauxite or ceramic granules.

It is well know that advances in coil tubing technology have generated an increased interest in using coil tubing during well completion, re-completion and workover procedures. Techniques have been developed over the years for pumping well fracturing fluids through coil tubing, or pumping "down the backside" around the coil tubing. Processes and equipment have also been developed for perforating casing and fracturing a production zone in a single operation, as described in Applicant's U.S. Pat. No. 6,491,098 entitled Method and Apparatus for Perforating and Stimulating Oil Wells, which issued on Dec. 10, 2002.

Although performing two or more functions in a single run down a cased wellbore is economical and desirable, there is a disadvantage with using existing techniques for performing such operations. The principal disadvantage is the height of the equipment stack that is necessary for lubricating the required tool string into the well.

FIG. 1 is a schematic diagram of a setup 10 for performing a well completion in accordance with the prior art techniques in which a long tool string (not shown), e.g. a tool string for perforating and stimulating production zones of the well in a single run, are lubricated into the cased well bore.

As schematically illustrated in FIG. 1, a wellhead generally indicated by reference numeral 12 includes a casing head 14 supported by a conductor 16. The casing head 14 supports a surface casing 18. A tubing head spool 20 is mounted to the casing head 14. The tubing head spool 20 supports a production casing 22, which extends downwardly through the production zone(s) of the well.

Mounted to a top of the tubing head spool 20 is a blowout preventer protector (BOP) 24 for controlling the well after the production casing 22 is perforated. Optionally mounted to a top of the BOP is a "frac cross" 26, also referred to as a fracturing head. The purpose of the frac cross 26 is to permit well stimulation fluids to be pumped down the backside, i.e. down production casing 22, and around a coil tubing 34.

Mounted to a top of the frac cross 26 is one or more "lubricator joints" 28. In this example three lubricator joints 28*a*, 28*b* and 28*c* are used. The lubricator joints house the downhole tool string (not shown), which is supported by the coil tubing string 34. A wireline BOP or a coil tubing BOP 30 is mounted to a top of the lubricator joints 28*a*,28*b*,28*c*. Tubing rams of the coil tubing BOP 30 seal around the coil tubing string 34 while the tool string is being run into and out of the well. A wireline grease unit (not shown) or a coil tubing injector 32 is mounted to a top of the coil tubing BOP 30. The coil tubing injector 32 is used to run the coil tubing string 34 into and out of the production casing 22 in a manner well known in the art. The coil tubing string 34 is supplied from a coil tubing spool 36, which is likewise well known in the art and may be mounted on a trailer or a truck.

As is apparent, the setup 10 shown in FIG. 1 creates an equipment stack that extends 20'-40' from the ground. The setup 10 is in a normally assembled on the ground and hoisted into place after it is assembled. For the sake of clarity, the stays, work platforms, cranes and other equipment required to assemble, disassemble, operate, and maintain the setup 10 are not shown.

As will be understood by those skilled in the art, assembling and operating the setup 10 can be dangerous, because maintenance work must be performed on elevated work platforms high off the ground. As will be further understood, the setup 10 can also be dangerous because a great deal of mechanical bending and twisting stress is placed on the wellhead 12 and the lubricator 28 by the very high setup 10, which acts as a lever when force is applied to a top of the setup 10 by operation of the coil tubing injector or 32 or the wireline unit (not shown).

As will also be appreciated by those skilled in the art, assembling the setup 10 is expensive because heavy hoisting equipment, such as an 80-ton crane, is required to hoist the equipment to those heights. The 80-ton crane must also be connected to a top of the setup 10 and used to counter force applied to the setup 10 by operation of the coil tubing injector 32 or the wireline unit. The 80-ton crane must therefore remain on the job during the entire well stimulation process. The rental of such hoisting equipment for an extended period of time is very expensive.

There is therefore a need for a way of facilitating well completion, re-completion and workover while preserving the time and cost savings of being able to perform more than one function during a single run into a cased wellbore.

SUMMARY OF THE INVENTION

It is therefore an object of the invention to provide a method for facilitating and improving the safety of well completion, re-completion and workover while preserving the time and cost savings of being able to perform more than one function during a single run into a cased wellbore.

The invention therefore provides a method of subsurface lubrication into a cased wellbore, comprising: running a bottom end of a subsurface lubricator downward through a wellhead into an upper section of production casing supported by the wellhead until the subsurface lubricator is in a lubricated-in position, the production casing being larger than and connected to a lower section of production casing of the cased wellbore; and securing the subsurface lubricator in the lubricated-in position; whereby full-bore access to the lower section of the production casing of the cased wellbore is provided by the subsurface lubricator.

The invention further provides a method of lubricating a downhole tool string into a wellbore cased with an upper section of production casing of a first diameter and a lower section of production casing of a second, smaller diameter than the diameter of the upper section of production casing, the method comprising: mounting a subsurface lubricator containing the downhole tool string above a pressure control gate mounted to a wellhead of the cased wellbore; and opening the pressure control gate and running the subsurface lubricator through a wellhead of the cased wellbore and into the upper section of the production casing.

The invention yet further provides a method of lowering a working height of equipment used for well completion, recompletion or workover of a cased wellbore, comprising using a subsurface lubricator mounted to a wellhead of the cased wellbore to lubricate a downhole tool string into the cased wellbore by running the subsurface lubricator through the wellhead and into an upper section of a production casing of the cased wellbore.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a method of subsurface lubrication in order to facilitate well competition, re-completion and workover. The method employs a subsurface lubricator that is run down through a wellhead of the well and into an upper section of a production casing supported by the wellhead. The method permits long tool strings to be lubricated into the well and significantly reduces a distance that a coil tubing injector or a wireline grease injector for a wireline for controlling the tool string is located above the ground after the tool string has been lubricated into the well. This significantly reduces expense and improves safety by lowering working height and reducing mechanical stress on the wellhead.

Figure 2:
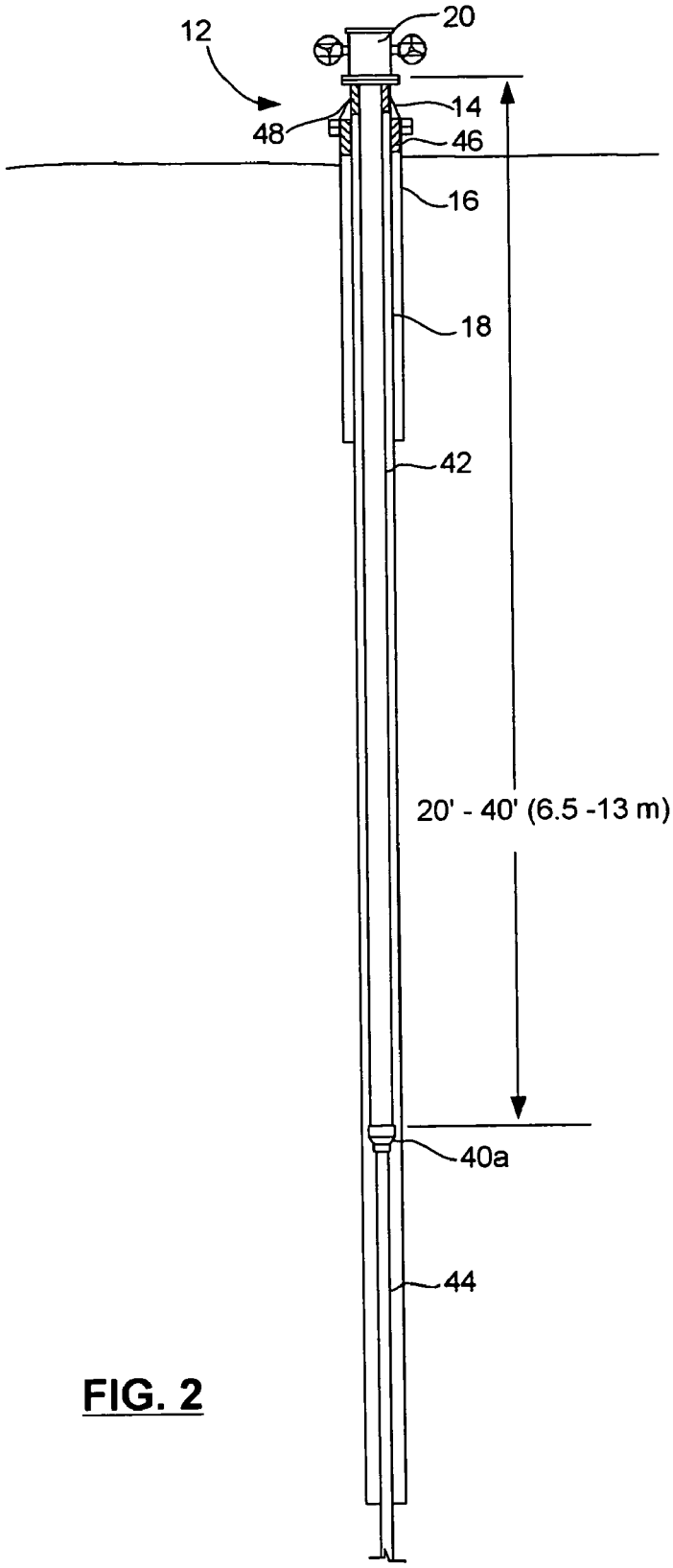
FIG. 2 is a schematic diagram of a well cased in accordance with an embodiment of the invention.

FIG. 2 is a schematic diagram partially in cross-section showing a well cased for subsurface lubrication. As schematically shown in FIG. 2, the surface casing 18 is supported by a casing mandrel or casing slips 46 in a manner well known in the art. A casing transition nipple. 40*a* connects an upper section of production casing 42 to a lower section of production casing 44. The upper section of production casing 42 has a larger diameter than the lower section of production casing 44. For example, the upper section of production casing 42 may have a diameter of 7 inches or 7⅝ inches. The lower section of production casing 44 is of a standard casing size, e.g. 4½ inches or 5½ inches. A lower section of the production casing extends from the casing transition nipple 40*a* to the bottom of the well.

In one embodiment the upper section of production casing 42 has a length of 30-40 feet. It may be, for example, one joint of casing, which is typically 30 feet in length. However, the upper section of production casing 42 may be shorter or longer than 30 feet, depending on anticipated need.

In this embodiment, the casing transition nipple 48 is box threaded on each end as will be explained below in more detail with reference to FIG. 6.

Figure 3:
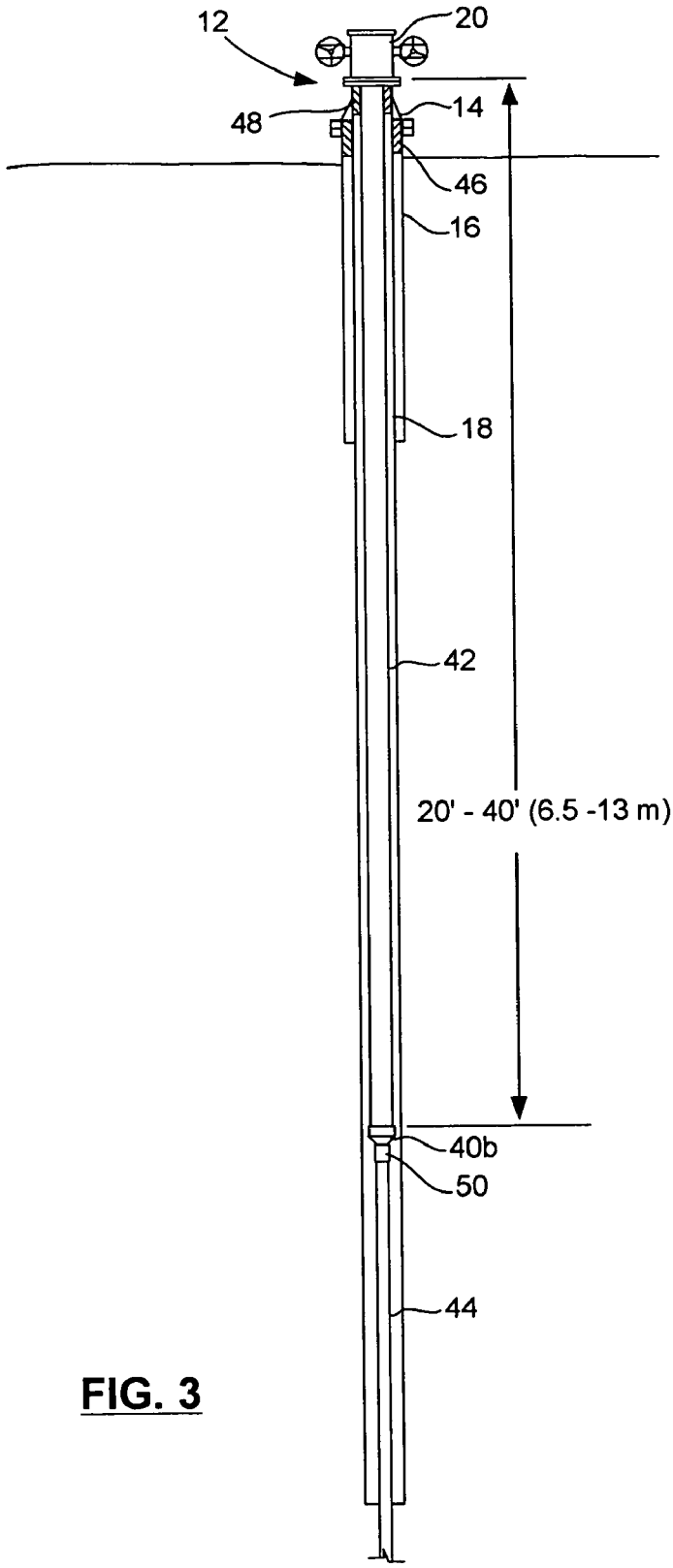
FIG. 3 is a schematic diagram of a well cased in accordance with another embodiment of the invention.

FIG. 3 is a schematic diagram partially in cross-section showing a well cased for subsurface lubrication. The upper section of production casing 42 and the lower section of production casing 44 are identical to that described above with reference to FIG. 2. In this embodiment, a casing transition nipple 40*b* has a box end for connection to the upper section of production casing 42 and a nipple end for connection to the lower section of production casing 44. Consequently, a casing collar 50, commonly known in the art for connecting joints of casing, is used to connect the nipple end of the casing transition nipple 40*b* to the lower section of the production casing 44. This will be explained below in more detail with reference to FIG. 7.

Figure 4:
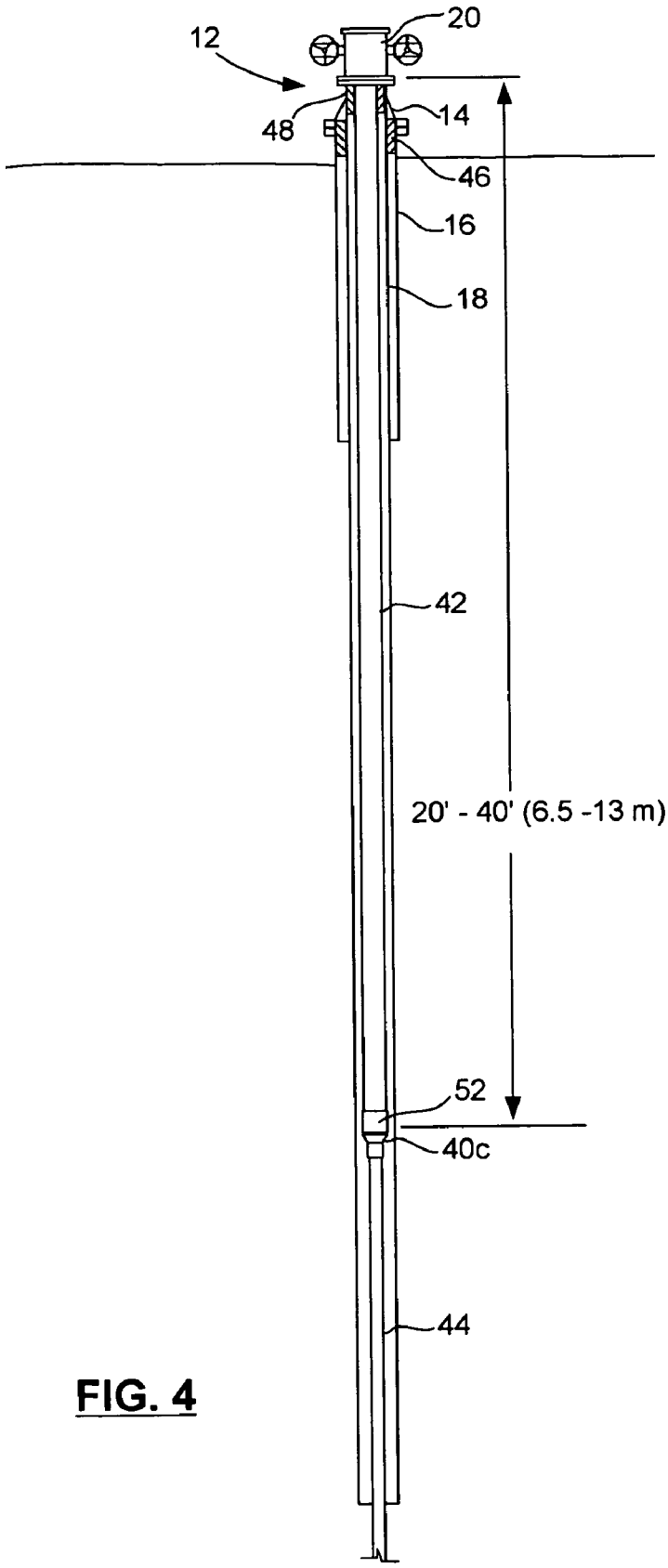
FIG. 4 is a schematic diagram of a well cased in accordance with yet another embodiment of the invention.

FIG. 4 is a schematic diagram partially in cross-section showing a well cased in accordance with yet a further embodiment for subsurface lubrication. The upper section of the production casing 42 and the lower section of the production casing 44 are the same as that described above with reference to FIG. 2. In this embodiment, the casing transition nipple 40*c* is pin threaded for connection to the upper section of the production casing 42 and box threaded for connection to the lower section of the production casing 44. Consequently, a casing collar 52 is used to connect the upper section of the production casing 42 to the transition nipple 40*c*, as will be explained below in more detail with reference to FIG. 8.

Figure 5:
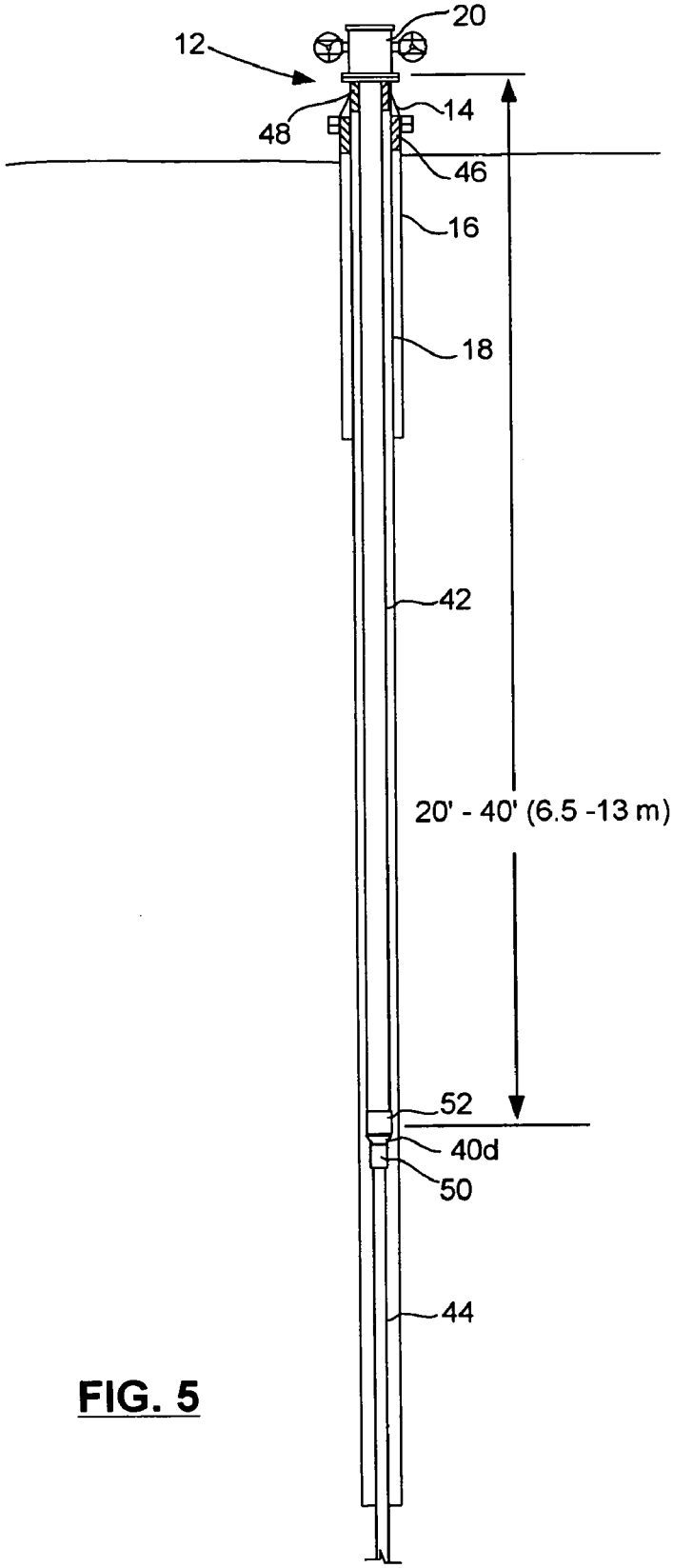
FIG. 5 is a schematic diagram of a well cased in accordance with yet a further embodiment of the invention.

FIG. 5 is a schematic diagram partially in cross-section showing a well cased in accordance with yet another embodiment for subsurface lubrication. The upper section of the production casing for 42 and the lower section of the production casing 44 are the same as that described above with reference to FIG. 2. In this embodiment, the casing transition nipple 40*c* is pin threaded for connection to the upper section of the production casing 42 and pin threaded for the connection of the lower section of the production casing 44. Consequently, a casing collar 52 is used to connect the upper section of the production casing 42 to the casing transition nipple 40*d*, and a casing collar 50 is used to connect the lower section of the production casing 44 to the casing transition nipple 40*d*, as will be explained below in more detail with reference to FIG. 9.

Figure 6:
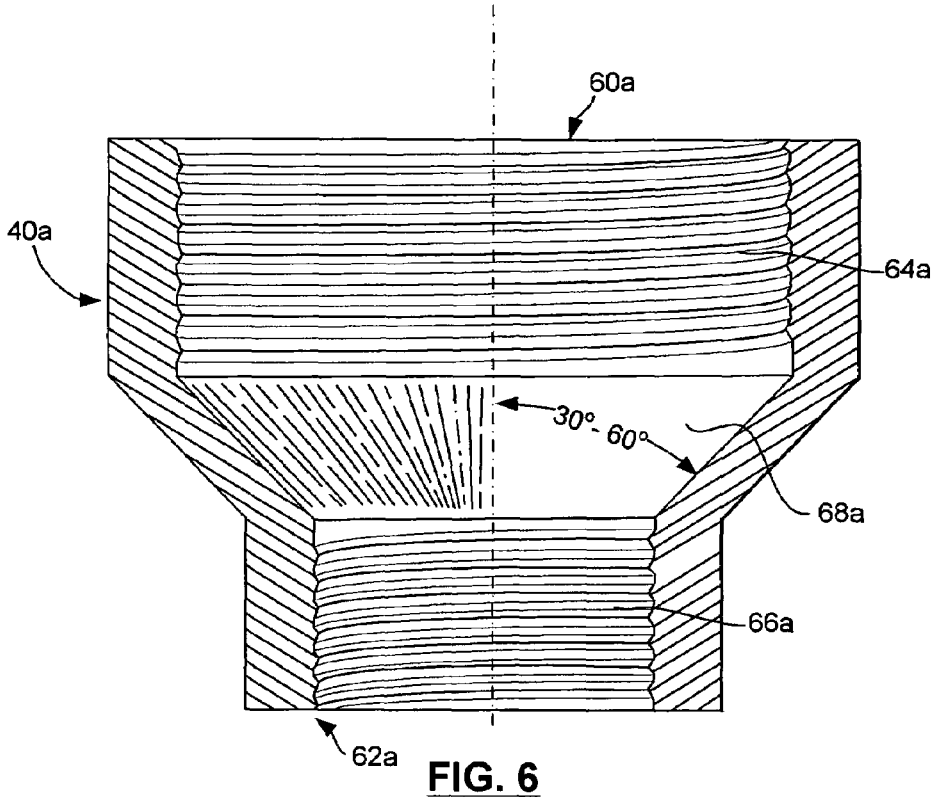
FIG. 6 is a cross-sectional schematic diagram of the casing transition nipple shown in FIG. 2.

FIG. 6 is a cross-sectional schematic view of the casing transition nipple 40*a* shown in FIG. 2. The casing transition nipple 40*a* has a top end 60*a* for connection to the upper section of the production casing 42. The casing transition nipple 40*a* also has a bottom end 62*a* for connection of the lower section of the production casing 44. The casing transition nipple 40*a* further includes a smooth, annular downwardly inclined tool guide surface 68*a*. As illustrated, in one embodiment the tool guide surface 68*a* is downwardly inclined at an angle of about 30°-60°from a plane that is perpendicular to the top end 60*a* and the bottom end 62*a* of the casing transition nipple 40*a*.

The top end 60*a* has a box thread 64*a* , which engages a pin threaded end of the upper section of the production casing 42. The box thread 64*a* is shown schematically, and extends all of the way from the top end 60*a* to a top of the tool guide surface 68*a*. As is understood by those skilled in the art, casing is available in a plurality of thread patterns. For example, casing may be threaded using a Buttress, Hydril, Acme, Rucker Atlas, EUE 8-round, EUE 10-round, EUB 8-V or EUE 10-V thread pattern, and this list is not exhaustive. It should therefore be understood that the thread pattern used to machine threads on any of the box threaded or pin threaded ends described above and below is purely a matter of design choice, and the schematically illustrated threads shown in FIGS. 6-9 are intended to be representative of any thread pattern applied to casing, as well as any other method that may be used for connecting the casing 40, 42 to the casing transition nipple 40*a-d*. The bottom end 62*a* likewise includes a box thread 66*a* for direct connection of a pin threaded top end of the lower section of the production casing 44. The box thread 66*a* likewise extends upwardly all of the way from the bottom end 62*a* to a bottom of the tool guide surface 68*a*. As can be seen in FIG. 6. a thickness of a sidewall of the casing transition nipple 40*a* is consistent from the top end 60*a* to the bottom end 62*a*.

Figure 7:
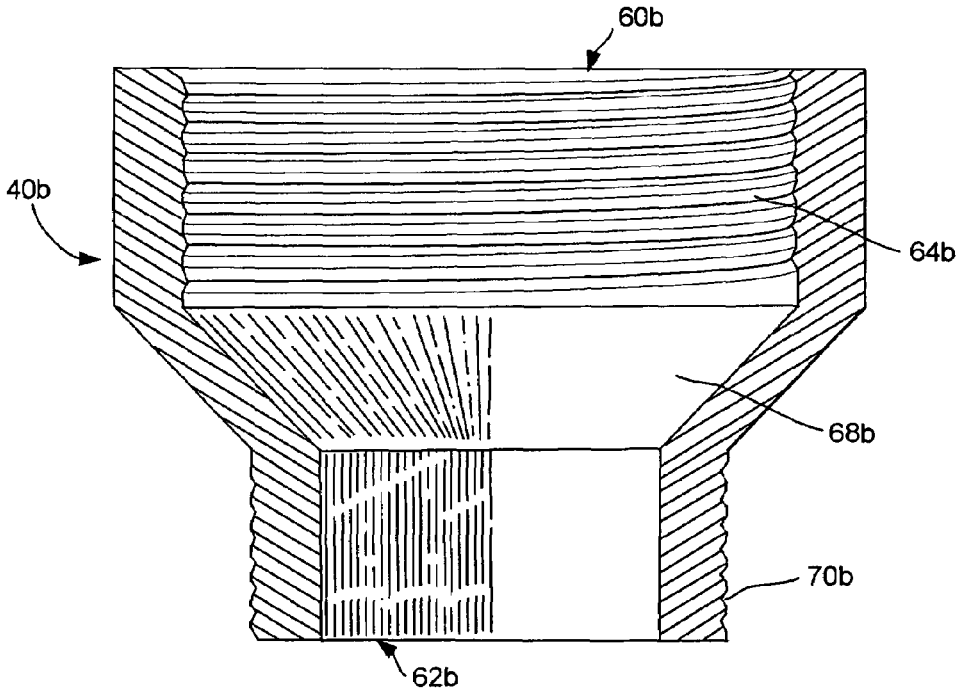
FIG. 7 is a cross sectional schematic diagram of the casing transition nipple shown in FIG. 3.

FIG. 7 is a cross-sectional schematic diagram of the casing transition nipple 40*b* shown in FIG. 3. The casing transition nipple 40*b* is identical to the casing transition nipple 40*a* described above with reference to FIG. 6 with the exception that the bottom end 62*b* is pin threaded. As explained above with reference to FIG. 3, a casing collar 50 is used to connect the lower section of production casing 44 to the pin thread 70*b* of the casing transition nipple 40*b*. The upper section of the production casing 42 is threaded directly to a box thread 64*b* in the too end 60*b* of the casing transition nipple 40*b*. The box thread 64*a* extends downwardly from the too end 60*b* all of the way to the top of the tool guide surface 68*b*. A smooth internal bore extends upwardly from the bottom end 62*b* to the bottom of the tool guide surface 68*d*. As can be seen in FIG. 7. a thickness of a sidewall of the casing transition nipple 40*b* is consistent from the too end 60*b* to the bottom end 62*b*.

Figure 8:
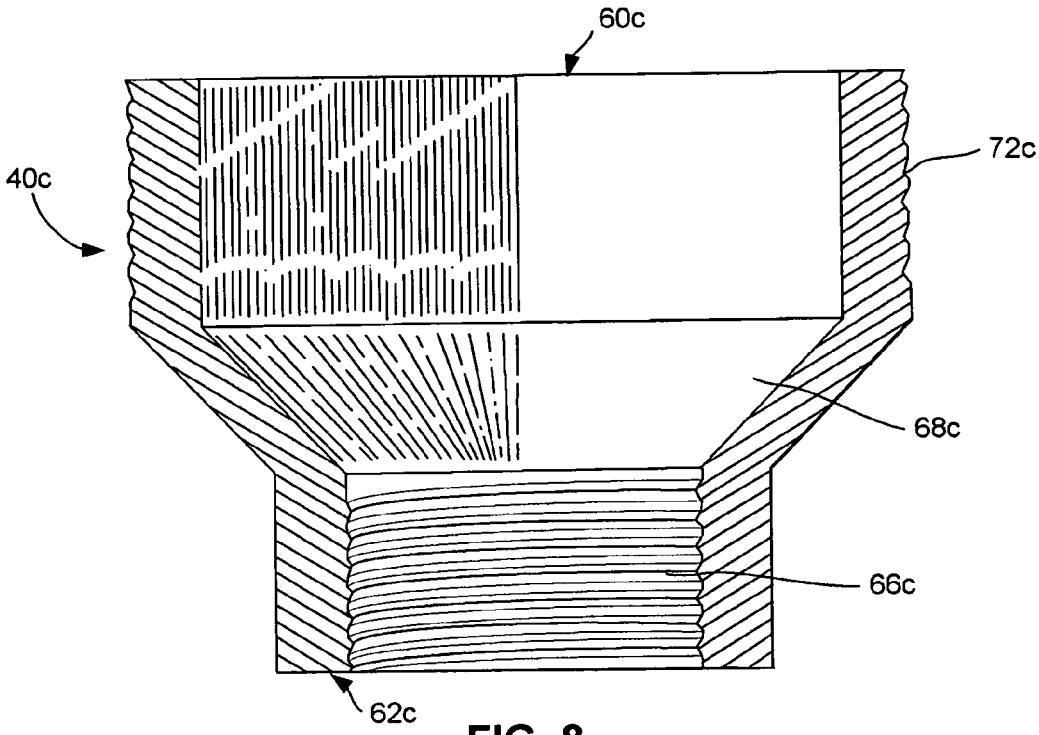
FIG. 8 is a cross-sectional schematic diagram of the casing transition nipple shown in FIG. 4.

FIG. 8 is a schematic cross-sectional view of a casing transition nipple 40*c* described above with reference to FIG. 4. The casing transition nipple 40*c* is the same as the casing transition nipple 40*a* described above, with the exception that the top end 60*c* has a pin thread 72*c* and the bottom end 62*c* has a box thread 66*c*. Consequently, a casing collar 52 is used to connect the production casing 42 to the top end 60*c* of the casing transition nipple 40*c*. As explained above, the lower section of production casing 44 is connected directly to the box thread 66*c* of the casing transition nipple 40*c*. A smooth internal bore extends downwardly from the too end 60*c* to the too of the tool guide surface 68*c*. The box thread 66*c* extends upwardly from the bottom end 62*c* to the bottom of the tool guide surface 68c. As can be seen in FIG. 8. a thickness of a sidewall of the casing transition nipple 40*c* is consistent from the too end 60*c* to the bottom end 62*c*.

Figure 9:
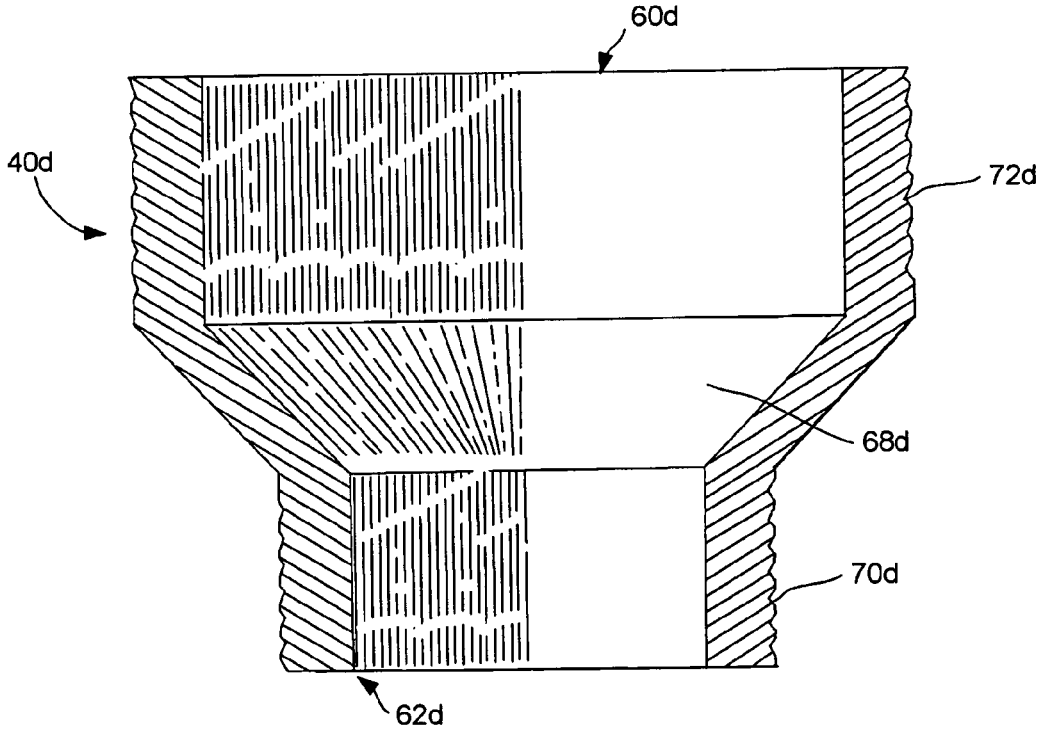
FIG. 9 is a cross-sectional schematic diagram of the casing transition nipple shown in the FIG. 5.

FIG. 9 is a schematic cross-sectional view of the casing transition nipple 40*d* described above with reference to FIG. 5. The casing transition nipple 40*d* is the same as the casing transition nipple 40*a* described above with reference to FIG. 6 with the exception that the top end 60*d* has a pin thread 72*d* and the bottom end 62*d* also has a pin thread 70*d*. Consequently, as described above with reference to FIG. 5 a casing collar 52 is used to connect the upper section of production casing 42 to the pin thread 72*d* of the top end 60*d*. Likewise, a casing collar 50 is used to connect the lower section of production casing 44 to the pin thread 70*d* of the bottom end 62*d* of the casing transition nipple 40*d*. A smooth internal bore extends downwardly from the too end 60*d* to the too of the tool guide surface 68*d*. A smooth internal bore also extends upwardly from the bottom end 62*d* to the bottom of the tool guide surface 68*d*. As can be seen in FIG. 9. a thickness of a sidewall of the casing transition nipple 40*d* is consistent from the ton end 60*d* to the bottom end 62*d*.

Figure 1:
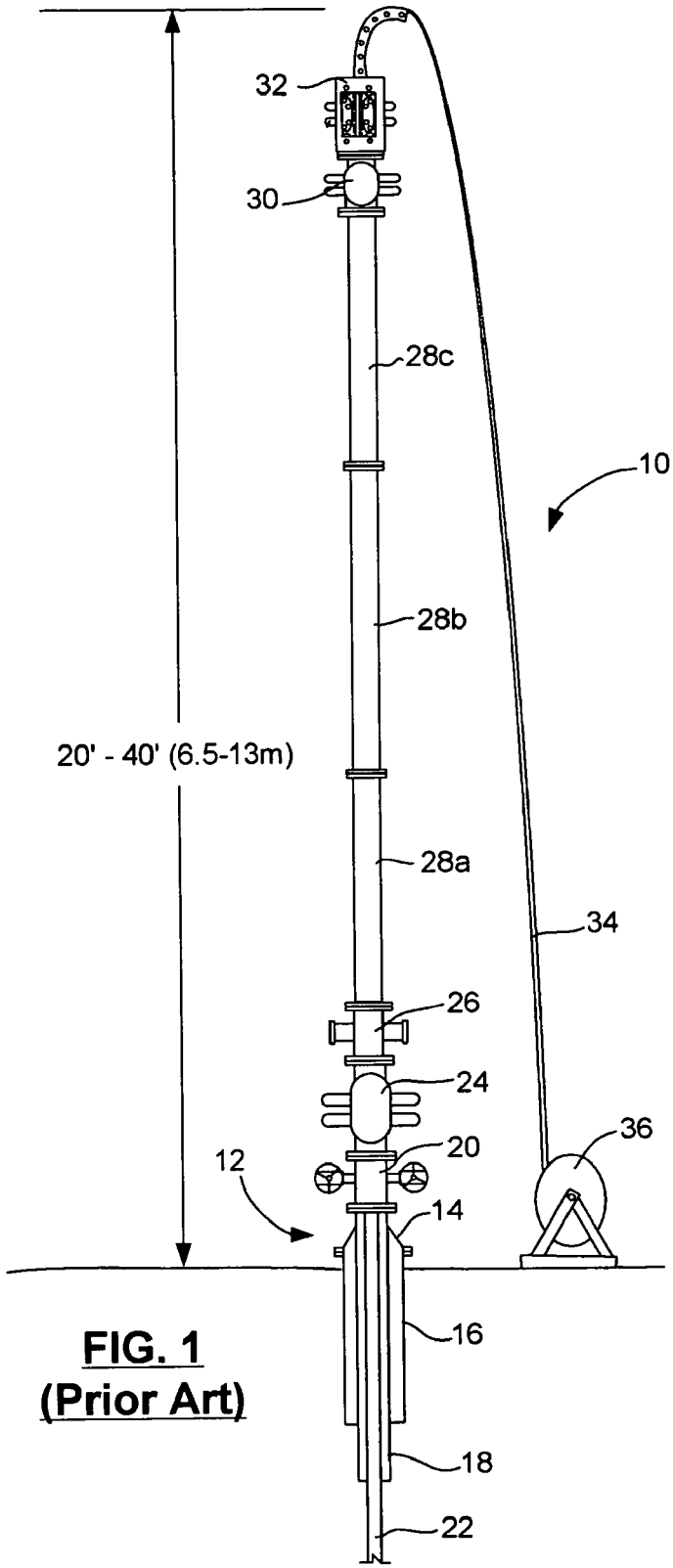
FIG. 1 (Prior Art)
FIG. 1 is a schematic diagram of a prior art setup for running a long downhole tool string into a production casing of a well in order to perform more than on function in a single run into the well.
Figure 10:
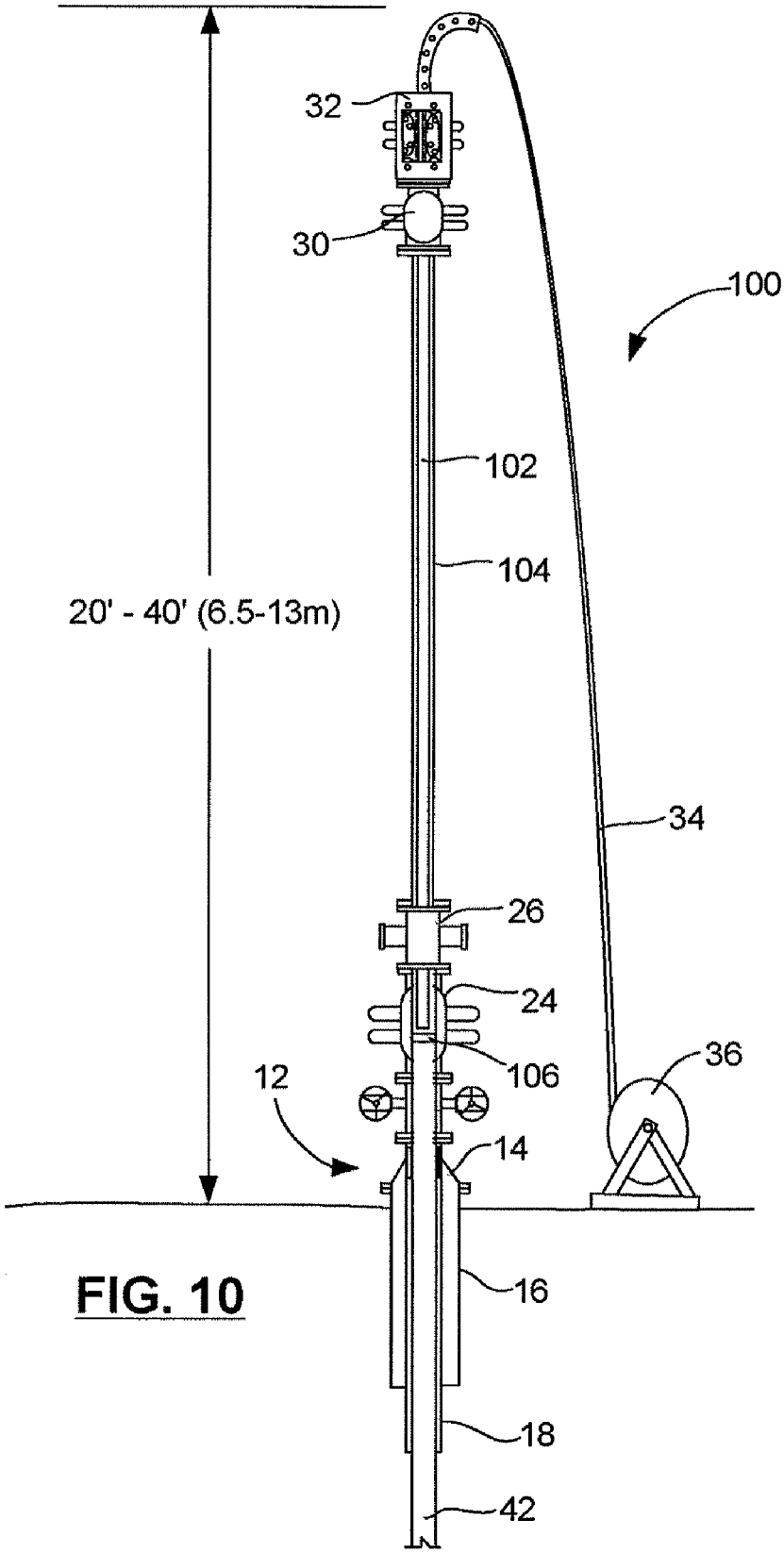
FIG. 10 is a schematic diagram of a setup for lubricating a long downhole tool string into a well cased in accordance with the invention.

FIG. 10 is a schematic view partially in cross-section of a setup 100 for running a long downhole tool string 102 into a wellbore cased for downhole lubrication. The setup 100 is very similar to the setup 10 described above with reference to FIG. 1, with the exception that the lubricator joints 28*a -c* are replaced by a subsurface lubricator 104 that is schematically illustrated. The structure of the subsurface lubricator 104 is not described because it is not within the scope of this invention. None of the control structure for the subsurface lubricator 104 is illustrated for the purposes of clarity. In this example, the subsurface lubricator 104 is mounted to a top of the frac cross 26, which is in turn mounted to a top of a blowout preventer 24 as described above with reference to FIG. 1. As will be understood by those skilled in the art, the subsurface lubricator may also be mounted directly to a top of the blowout preventer 24 or another pressure control gate, such as a high pressure valve, or the like.

As will be understood by those skilled in the art, any of the above the threaded connections may be made permanent using a thread glue such as Baker Lock®. Furthermore, any of the above connections may be welded connections, glued connections, or connections made using any one of a number of fluid tight quick-lock, screw-lock or other locking connectors that are known in the art.

As will be further understood by those skilled in the art, prior to lubricating in the long downhole tool string 102 the pressure control gate, in this example blind rams 106 of the blowout preventer 24, is closed to seal an annulus of the upper section of the production casing 42. Due to a length of the downhole tool string 102, a height of the setup 100 is 20'-40', similar to the setup 10 shown in FIG. 1.

Figure 11:
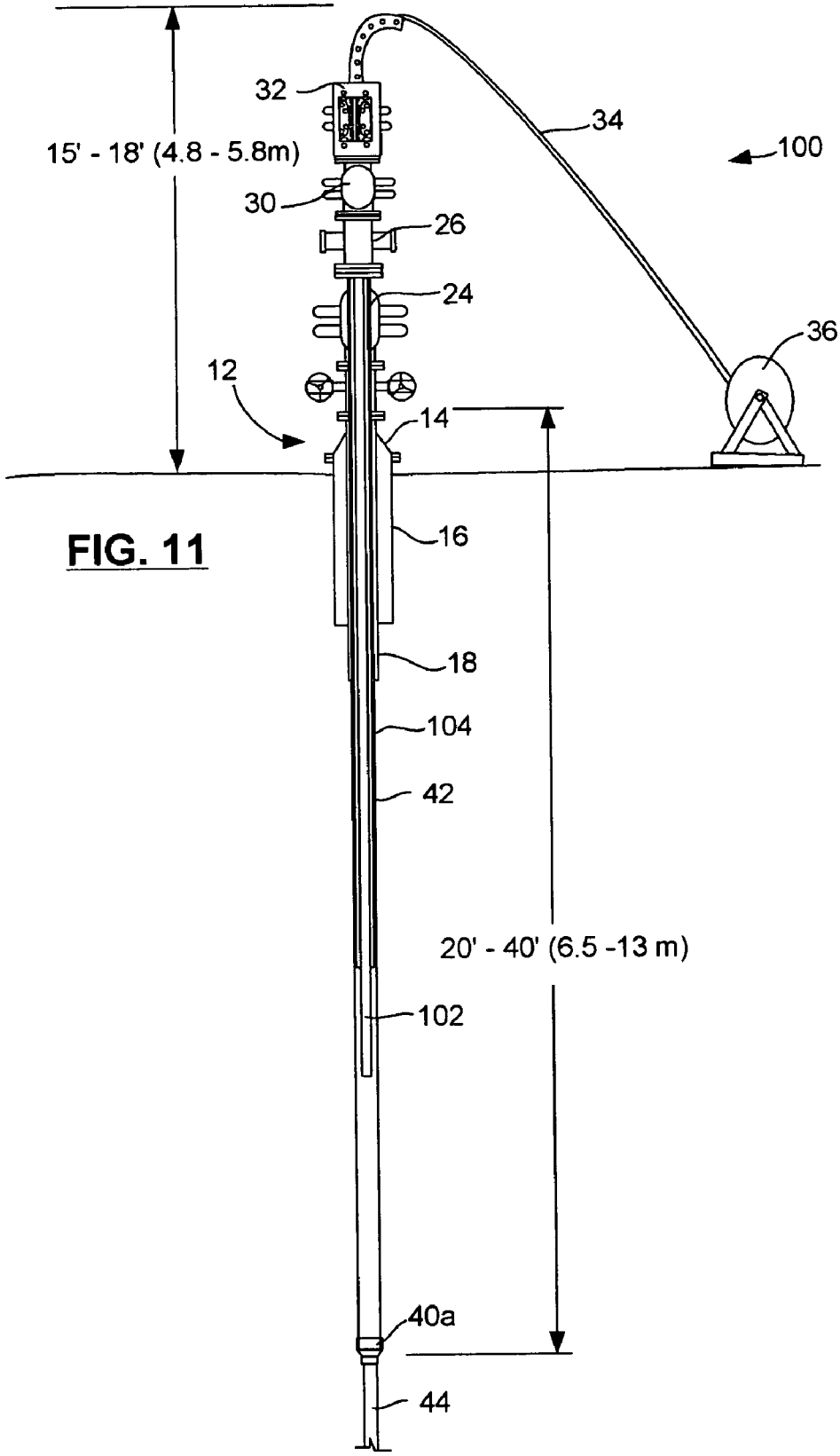
FIG. 11 is a schematic diagram of the setup shown in FIG. 10, illustrating the long downhole tool string in a "lubricated-in " condition.

FIG. 11 is a schematic diagram partially in cross-section of the setup 100 after it has been lubricated into the wellbore cased in accordance with the invention. As will be understood by those skilled in the art, the subsurface lubricator 104 has been lowered down through the blowout preventer protector 24 and the wellhead 14 and into the upper section of the production casing 42 to a locked-down condition in which a well completion, recompletion or workover procedure is ready to be performed. As can be seen, in the locked-down position a height of a top of the coil tubing injector 32 is about 15'-18' above the ground, as opposed to about 40' above the ground for the setup 10 shown in FIG. 1. The setup 100 reduces cost because a crane is not required to stabilize the setup 100 after it is lubricated in. The setup 100 also significantly improves a work safety and facilitates equipment maintenance because of the reduced working height. As will be understood by those skilled in the art, mechanical bending and twisting stresses on the wellhead 14 are also significantly reduced. This is not only due to the reduced working height of the setup 100, but also due to the subsurface lubricator 104 which runs inside the upper section of the production casing 42 and thereby lends significant rigidity to the wellhead components through which it is run. Consequently, rather than mechanically stressing the wellhead, the setup 100 actually reinforces the wellhead and substantially eliminates any possibility that the wellhead could be damaged by the mechanical bending and twisting forces exerted by coil tubing or wireline units when long tool strings are lubricated into or out of the well.

Figure 12:
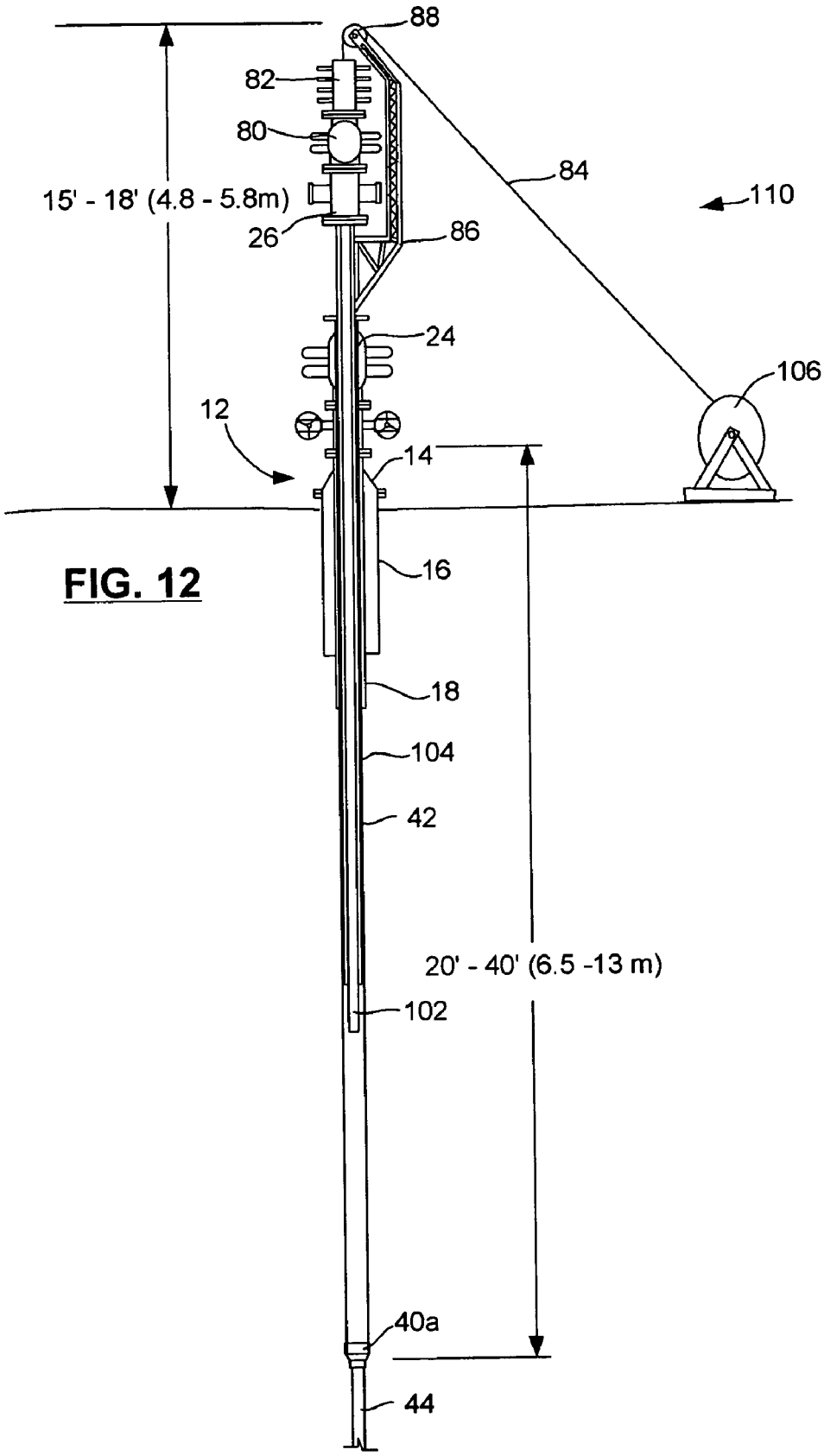
FIG. 12 is a schematic diagram of a setup in accordance with another embodiment of the invention illustrating the long downhole tool string in a lubricated-in condition, the setup being configured to run the long downhole tool string into the well using a wireline unit.

FIG. 12 is a schematic diagram partially in cross-section of another setup 110 in accordance with the invention, showing the long downhole tool string 102 in a lubricated-in condition. The setup 110 is configured to lower the long downhole tool string 102 into the wellbore cased in accordance with the invention using a wireline unit 106, which is schematically illustrated. As understood by those skilled in the art, a wireline 84 of the wireline unit 106 runs over a wireline sheave 88 and through a grease injector 82. The grease lines, pumps and other components of the grease injector 82 are not shown. The wireline 84 runs through a wireline BOP 80 and the frac cross 26. The wireline 84 is connected to a top of the long downhole tool string 102. In this example, the wireline sheave 88 is supported by a sheave boom 86 mounted to a side of the subsurface lubricator 104, so that a crane is not required to support the wireline sheave 88. The setup 110 provides all of the advantages described above with reference to the setup 100.

The method for subsurface lubrication in accordance with the invention therefore and improves work safety, enables downhole operations that were heretofore impossible, impractical or excessively dangerous, and reduces cost by lowering the overall working height after a long downhole tool string is been lubricated into the cased well.

As will be understood by those skilled in the art, the setups 100, 110 are exemplary only. Many other arrangements of the wellhead, the pressure control gate, and the downhole tool string control equipment can be used for subsurface lubrication. It should also be understood that the method of subsurface lubrication in accordance with the invention can also be used in a prior art cased wellbore to lubricate in a downhole tool string having a diameter that is less than a diameter of the production casing. For example to lubricate in a 4½ inch tool string into a 5½ inch production casing. The embodiments of the invention described are therefore intended to be exemplary only, and the scope of the invention is intended to be limited solely by the scope of the appended claims.

I claim:

1. A method of subsurface lubrication into a cased wellbore, comprising:

running a bottom end of a subsurface lubricator downward through a wellhead into an upper section of production casing supported by the wellhead until the subsurface lubricator is in a lubricated-in position in which a top end of the subsurface lubricator remains above the wellhead, the upper section of the production casing being larger than and connected to a lower section of production casing of the cased wellbore; and securing the subsurface lubricator in the lubricated-in position;

whereby full-bore access to the lower section of the production casing of the cased wellbore is provided by the subsurface lubricator.

2. The method as claimed in claim 1 wherein running the bottom end of the subsurface lubricator down through the wellhead further comprises running the bottom end of the subsurface lubricator down through a pressure control gate mounted above the wellhead.

3. The method as claimed in claim 2 wherein running the bottom end of the subsurface lubricator down through the pressure control gate comprises running the bottom end of the subsurface lubricator through a blowout preventer or a high pressure valve.

4. The method as claimed in claim 1 further comprising mounting a coil tubing blowout preventer or a wireline blowout preventer to a top end of the subsurface lubricator prior to running the bottom end of the subsurface lubricator down through the wellhead.

5. The method as claimed in claim 4 further comprising mounting a coil tubing injector to a top of the coil tubing blowout preventer, or mounting a grease injector to a top of the wireline blowout preventer.

6. The method as claimed in claim 5 further comprising running a coil tubing string through the coil tubing injector and the coil tubing blowout preventer and connecting the downhole tool string to an end of the coil tubing string, or running a wireline through the grease injector and the wireline blowout preventer and connecting the downhole tool string to an end of the wireline.

7. The method as claimed in claim 6 wherein prior to running the bottom end of the subsurface lubricator down through the wellhead, the method further comprises drawing the downhole tool string into the subsurface lubricator using the coil tubing or the wireline.

8. The method as claimed in claim 6 further comprising operating the coil tubing injector or a wireline unit to run the downhole tool string into the lower section of the production casing.

9. A method of lubricating a downhole tool string into a wellbore cased with an upper section of production casing of a first diameter and a lower section of production casing of a second, smaller diameter than the diameter of the upper section of production casing, the method comprising:

mounting a subsurface lubricator containing the downhole tool string above a pressure control gate mounted above a wellhead of the cased wellbore; and opening the pressure control gate and running a bottom end of the subsurface lubricator through the wellhead of the cased wellbore and into the upper section of the production casing until a top end of the subsurface lubricator is adjacent a top end of the wellhead.

10. The method as claimed in claim 9 wherein prior to opening the pressure control gate, the method further comprises mounting a coil tubing blowout preventer or a wireline blowout preventer to a top of the subsurface lubricator.

11. The method as claimed in claim 10 further comprising mounting a coil tubing injector to a top of the coil tubing blowout preventer or a grease injector to a top of the wireline blowout preventer.

12. The method as claimed in claim 11 further comprising running a coil tubing string through the coil tubing injector and the coil tubing blowout preventer and connecting the coil tubing string to the downhole tool string, or running a wireline through the grease injector and the wireline blowout preventer and connecting the wireline to the downhole tool string.

13. The method as claimed in claim 12 further comprising operating the coil tubing injector to run the downhole tool string into the lower section of the production casing, or operating a wireline unit to run the downhole tool string into the lower section of the production casing after the subsurface lubricator has been run into the upper section of the production casing.

14. The method as claimed in claim 13 further comprising operating the downhole tool string to perform one of a well completion, recompletion and workover operation.

15. A method of lowering a working height of equipment used for well completion, recompletion or workover of a cased wellbore, comprising: mounting a subsurface lubricator containing a downhole tool string to a wellhead of the cased wellbore; lubricating the downhole tool string in the subsurface lubricator into the cased wellbore by running the subsurface lubricator through the wellhead and into an upper section of a production casing of the cased wellbore until the subsurface lubricator is in a lubricated-in position in which a top end of the subsurface lubricator remains above the wellhead.

16. The method as claimed in claim 15 wherein running the subsurface lubricator through the wellhead comprises running the subsurface lubricator through a pressure control gate mounted above the wellhead.

17. The method as claimed in claim 16 wherein running the subsurface lubricator through the pressure control gate comprises running the subsurface lubricator through a blowout preventer or a high pressure valve.

18. The method as claimed in claim 15 further comprising operating a coil tubing injector or a wireline unit to lower the downhole tool string down the cased wellbore.

* * * * *